US005819380A

United States Patent [19]

Paolercio et al.

[11] Patent Number: 5,819,380

[45] Date of Patent: Oct. 13, 1998

[54] BARREL LOCK

[75] Inventors: Anthony Paolercio, Pelham Manor, N.Y.; Eitan Weinberg, Fairlawn, N.J.

[73] Assignee: Michael Anthony Jewelers, Inc., Mount Vernon, N.Y.

[21] Appl. No.: 815,957

[22] Filed: Mar. 13, 1997

[51] Int. Cl.[6] ..... A44B 21/00; B65H 57/00

[52] U.S. Cl. ..... 24/615; 24/614; 24/616

[58] Field of Search ..... 24/615, 616, 617, 24/618, 614, 624; 63/2, 4, 13

[56] References Cited

U.S. PATENT DOCUMENTS

| | | | |
|---|---|---|---|
| 889,230 | 6/1908 | Hoffman | 24/616 |
| 1,082,140 | 12/1913 | Schönemann . | |
| 1,141,575 | 6/1915 | Naylor | 24/616 |
| 1,314,803 | 9/1919 | Heller . | |
| 1,361,645 | 12/1920 | Tomchin . | |
| 1,440,068 | 12/1922 | Ellin . | |
| 2,858,593 | 11/1958 | Irizarry | 24/616 |
| 2,986,792 | 6/1961 | Wyatt | 24/616 |
| 3,165,804 | 1/1965 | Marosy . | |
| 3,462,807 | 8/1969 | Marquardt . | |
| 4,426,854 | 1/1984 | Geldwerth et al. | 24/616 |
| 4,520,537 | 6/1985 | Valikov | 24/616 |
| 4,527,315 | 7/1985 | Sweet et al. | 24/615 |
| 4,534,090 | 8/1985 | Skobel . | |
| 5,257,512 | 11/1993 | Febrer . | |

FOREIGN PATENT DOCUMENTS

| | | | |
|---|---|---|---|
| 0313326 | 7/1919 | Germany | 24/616 |

*Primary Examiner*—Victor N. Sakran
*Attorney, Agent, or Firm*—Lilling & Cohen, LLP

[57] ABSTRACT

A barrel lock with a hollow cylindrical barrel having a perforated disk attached to one end thereof, and an elongated annular insert mounted within the barrel and extending from both ends of the barrel to provide loops at each end of the barrel. Preferably one end of the insert has a shoulder to engage the disk to prevent the annular insert from passing fully through the disk and the barrel. The barrel lock includes a spring clasp that is adapted to pass through the loop at the disk end of the barrel and also to pass through the perforation in the disk into the interior of the barrel. The spring clasp also engages and locks with the edges of the disk perforation when fully inserted.

12 Claims, 4 Drawing Sheets

BARREL LOCK

BACKGROUND OF THE INVENTION

The present invention relates to a barrel lock for use with necklaces, bracelets and other jewelry.

It is known to use tongue and slot fasteners for necklaces, bracelets, and the like. In such known fasteners, the female component is rigid and is provided with a simple recess into which a male component is inserted and retained. The male and female components generally are locked together by means of a spring mechanism as part of either the male or female components and which secures the components together. These fasteners generally are not fully reliable and often are not easily manufactured.

SUMMARY AND OBJECTS OF THE INVENTION

Therefore, it is an object of the present invention to provide a barrel lock for use with bracelets, necklaces, and the like which overcomes the shortcomings of existing fastening devices.

Another object of the present invention is to provide a barrel lock which is more reliable than existing devices.

A further object of this invention is to provide a barrel lock which prevents inadvertent disengagement of the device.

An additional object of this invention is to provide a barrel lock which may be manufactured in a relatively simple and straight-forward manner.

Various other objects, advantages and features of the present invention will become readily apparent to those of ordinary skill in the art, and the novel features will be particularly pointed out in the appended claims.

In accordance with the present invention, there is provided a barrel lock comprising a hollow cylindrical barrel with first and second ends, a disk with a central opening mounted on the first end of the barrel, a barrel insert which is within the barrel and coupled it, the insert having first and second ends extending beyond the first and second ends of the barrel, the barrel insert having a perforation through it, the first end of the barrel insert being adapted to engage the disk and prevent the first end of the insert from passing through the barrel, a spring clasp adapted to pass through the perforation of the first end of the insert and also being adapted to pass through the opening of the disk and lie within the barrel after passing through the insert perforation, the spring clasp being provided with means to engage and lock with edges of the disk opening in a locked position.

As one aspect of the present invention, the spring clasp includes an eye to which one end of a chain can be attached and the perforated second end of the barrel insert is adapted so that the opposite end of the chain can be attached to it.

As another aspect of the present invention, the opening of the disk is plus-shaped, and the engagement means on the spring clasp is a pair of locking notches adapted to abut against edges of the plus-shaped opening of the disk in the locked position.

As yet a further aspect of the present invention, the barrel insert is perforated over its full length and the spring clasp is sized to pass through said perforation when it is inserted into the barrel.

As yet another aspect of the present invention, the first end of the insert is adapted to engage the spring clasp when the spring clasp is released from the locked position.

In accordance with another embodiment of the present invention, a method of making a barrel lock is also provided. According to the method of the invention a hollow cylindrical barrel is fixedly coupled to a perforated disk at a first end of the barrel. A substantially flat annular member having a width at its center region which is approximately the same as the inside diameter of the cylindrical barrel is inserted through the perforated disk and affixed to the interior wall of the cylindrical barrel. The annular member is longer than the cylindrical barrel and the ends of the annular member extend beyond the barrel providing loops at each end of the barrel. Preferably, the first end of the annular member is wider than the perforation through the disk and is adapted to engage the disk and resiliently hold it in intimate contact with the barrel so that the disk, the annular member and the barrel can be affixed together by tray soldering. A spring clasp of conventional design is passed through the loop created by the annular member at the first end of the cylindrical barrel and is passed through the perforation in the disk to lie in the barrel. The spring clasp is provided with notches to engage and lock with the edges of the perforated disk when the spring clasp is fully inserted into the cylindrical barrel.

In accordance with a further embodiment of the present invention, a barrel lock is comprised of a male component and a female assembly. The female assembly includes a hollow cylindrical barrel, a disk having a central opening affixed to one end of the barrel and a perforated barrel insert mounted in the barrel and extending beyond both ends thereof. A shoulder on the barrel insert engages the disk. The ends of the perforated insert extending beyond the barrel define loops. The barrel insert is preferably affixed to the interior of the hollow cylindrical barrel by soldering. The male component is a spring clasp that is adapted to pass through the loop at the disk end of the barrel and to pass through the opening of the disk so that it lies within the barrel. The clasp is operable to lock with the disk.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS

Figure 1:
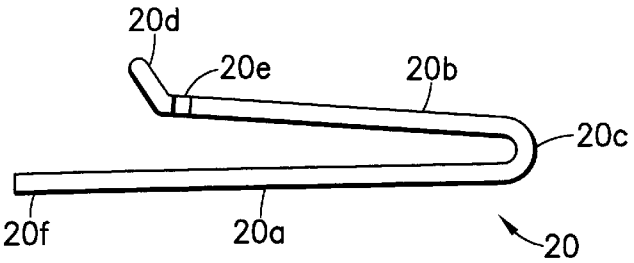
FIG. 1 is a side view of spring clasp 20.
Figure 2:
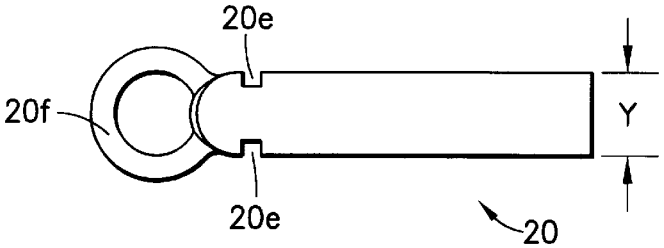
FIG. 2 is a top view of spring clasp 20.

Barrel lock 10 of the present invention is comprised of a male component to which one side of a chain, necklace, or the like is attached, and a female assembly to which the other side of the chain, necklace, etc., is attached. Referring to the drawings, spring clasp 20 shown in FIG. 1 is the male component of the barrel lock of the present invention. Spring clasp 20, which has a top view as shown in FIG. 2, is a strip of spring-like metal (or other resilient material) bent over on itself, so that its two ends (arms 20*a* and 20*b*) are adjacent, but sprung apart, and producing a U-shaped end 20*c*. As will be discussed, spring clasp 20 is adapted to fit and cooperate with the female assembly of the barrel lock. Spring clasp 20 includes a head 20*d* at the open end of arm 20*b* below which are two notches 20*e* which serve to engage disk 24 when barrel lock 10 is in the fully locked position. Arm 20*a* terminates, at its open end, with eye 20*f* to which one end of a bracelet or chain is secured.

Figure 3:
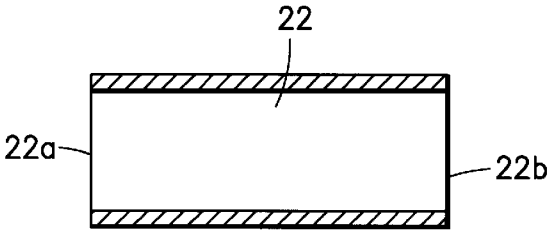
FIG. 3 is a side view of barrel 22.
Figure 4:
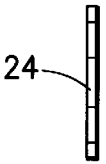
FIG. 4 is an edge view of disk 24.
Figure 5:
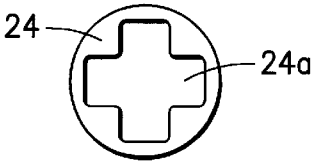
FIG. 5 is a side view of disk 24.

Female assembly 30 of the barrel lock is comprised of three components, barrel 22, disk 24, and barrel insert 26. Barrel 22 is shown in FIG. 3 and is hollow and cylindrical in shape. Barrel 22 may also have a different shape, e.g., oval, rectangular, or other polygonal. Disk 24, shown in FIG. 4, is permanently attached to open end 22*a* of barrel 22 by any suitable method known in the art, e.g., soldering when the components of barrel lock 10 are made of metal. Disk 24 preferably has the same cross-section as barrel 22 so that it suitably may be affixed thereto. Disk 24 includes a plus-shaped opening 24*a* as shown in the side view of FIG. 5. Alternatively, the opening may be T-shaped or another shape in which a relatively wider opening communicates with a narrower opening.

Figure 6:
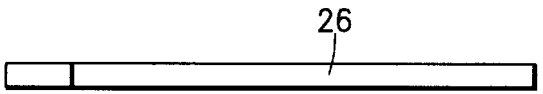
FIG. 6 is an edge view of barrel insert 26.
Figure 7:
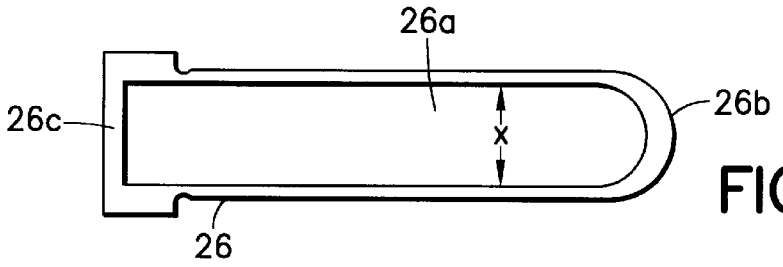
FIG. 7 is a top view of barrel insert 26.

Female component 30 also includes barrel insert 26 which is adapted to slide through opening 24*a* of disk 24 into barrel 22 as shown in FIGS. 6 and 7. Barrel insert 26 is a strip of metal (or other suitable material), and includes perforation 26*a*, as shown in FIG. 7. Barrel insert 26 is preferably U-shaped at end 26*b* and rectangular shaped at end 26*c*. The width of end 26*c* is larger than the width of U-shaped end 26*b* so that end 26*b* of barrel insert 26 can pass through the wider part of opening 24*a* in disk 24 until end 26*c* engages the edges of disk 24. End 26*c* of barrel insert 26 is wider than the widest portion of disk opening 24*a* which ensures that barrel insert 26 does not pass fully through disk 24 and subsequently fully through barrel 22. Barrel insert 26 at U-shaped end 26*b* has a width which is essentially the same as the inside diameter of barrel 22, so that the outside edge of U-shaped end 26*b* is placed in intimate contact with the interior surface of barrel 22. If barrel 22 has a shape other than cylindrical, for example oval, barrel insert 26 at U-shaped end 26*b* would preferably have a width which is essentially the same as the largest inside cross sectional dimension of barrel 22, so that the edge of U-shaped end 26*b* is resiliently held in position within barrel 22. The width (x) of perforation 26*a* is larger than the width (y) of spring clasp 20.

Figure 9:
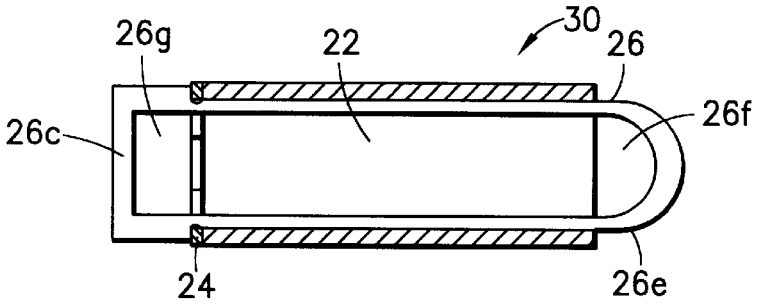
FIG. 9 is a top phantom view of female assembly 30 shown in FIG. 8.
Figure 8:
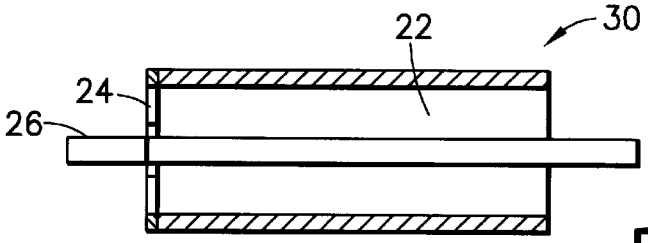
FIG. 8 is a phantom view of female assembly 30 comprising barrel 22, disk 24 and barrel insert 26 in accordance with the present invention.

FIG. 8 illustrates the completed female assembly 30. As better shown in the top view of female assembly 30 in FIG. 9, U-shaped end 26*b* of barrel insert 26 is longer than barrel 22 and extends beyond barrel 22. Perforation 26*a* also extends beyond barrel 22 defining loop opening 26*f*, through which a chain, or the like, can be attached to female assembly 30. Barrel insert 26 and insert perforation 26*a* also extend beyond the opposite end of barrel 22, and disk 24, defining clasp loop 26*g*.

To complete assembly of the female component, barrel insert 26 and disk 24 are permanently coupled to barrel 22 by any suitable method.

Having thus described the structure of the barrel lock, as well as a method for producing the same, a discussion of the operation of the barrel lock of the present invention will now be provided with reference to FIGS. 10–16 of the drawings. For purposes herein, it is assumed that one end of a bracelet (not shown) is attached to eye 20*f* of spring clasp 20 (see FIG. 2) and the other end of the bracelet is attached to loop 26 at the end of female component 30 (see FIG. 9).

Figure 10:
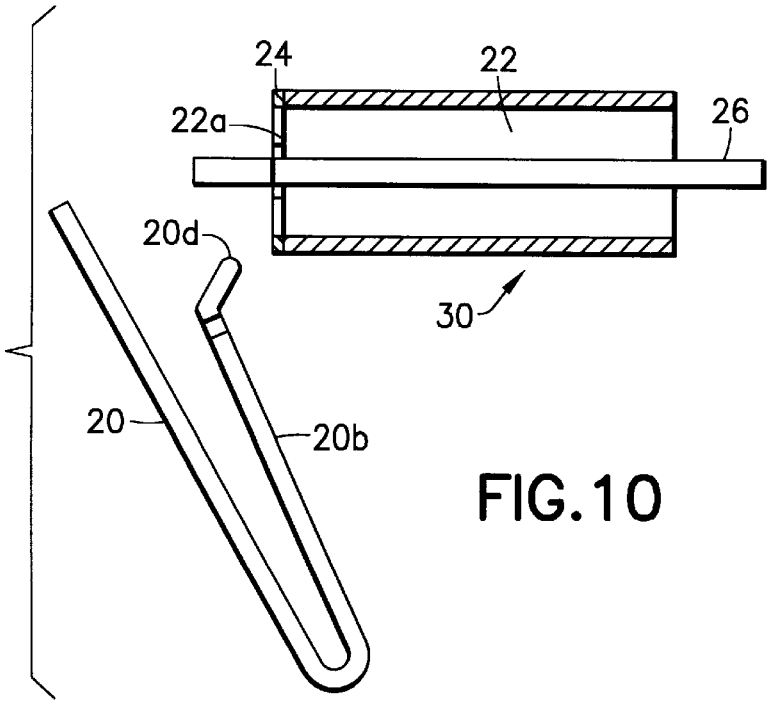
FIG. 10 is a phantom view of spring clasp 20 and female assembly 30 prior to engagement.
Figure 11:
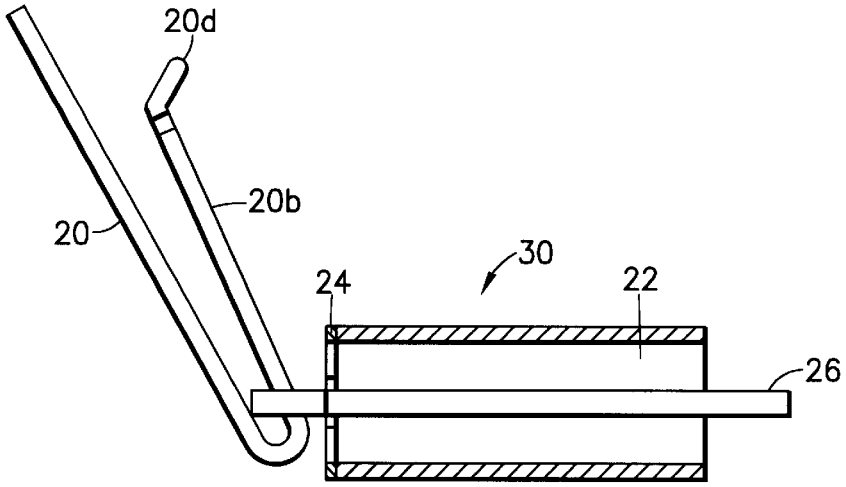
FIG. 11 is a phantom view of spring clasp 20 and female assembly 30 in a first engaged position of the barrel lock of the present invention.
Figure 12:
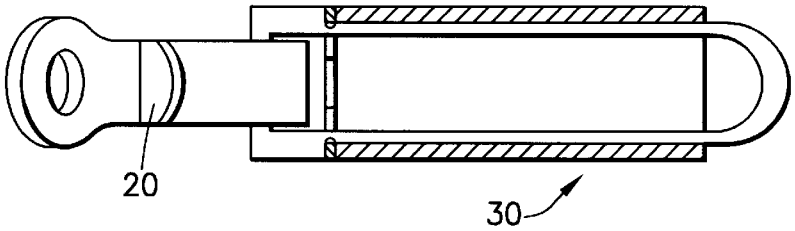
FIG. 12 is a phantom top view of spring clasp 20 and female assembly 30 in the position shown in FIG. 11.
Figure 13:
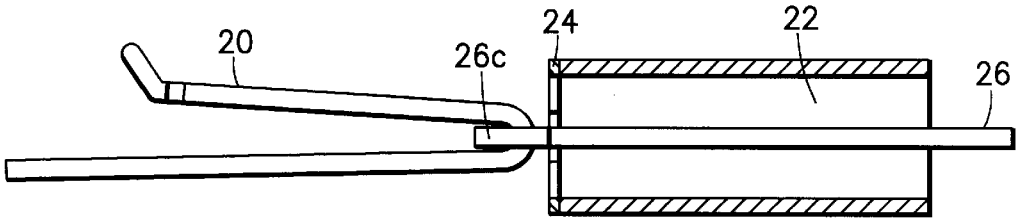
FIG. 13 is a phantom view of spring clasp 20 and female assembly 30 in a second engaged position of the barrel lock of the present invention.
Figure 14:
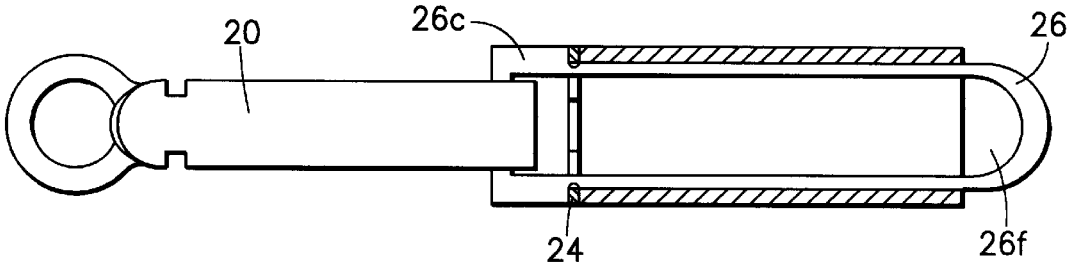
FIG. 14 is a top phantom view of spring clasp 20 and female assembly 30 in the position shown in FIG. 13.
Figure 15:
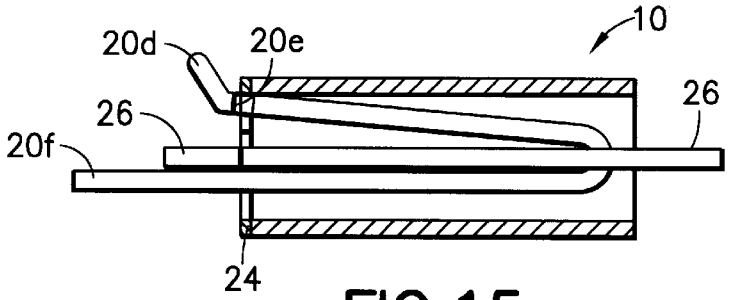
FIG. 15 is a phantom view of the barrel lock in a third, or fully, engaged position in accordance with the present invention.
Figure 16:
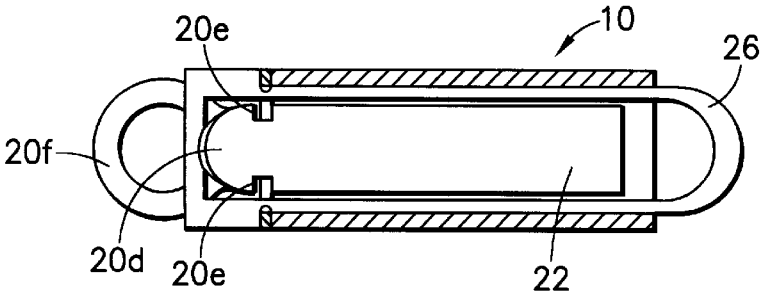
FIG. 16 is a top phantom view of the fully engaged barrel lock shown in FIG. 15.

To lock spring clasp 20 and female assembly 30 together, spring clasp 20 is brought into a somewhat perpendicular position to the barrel axis of female assembly 30, as shown in FIG. 10. Arm 20*b* (including head 20*d*) is brought through clasp loop opening 26*g*, into the position shown in FIGS. 11 and 12 (top view). Spring clasp 20 then is brought into parallel alignment with the cylinder axis of barrel 22, as shown in FIGS. 13 and 14 (top view). Spring clasp 20 is inserted through disk 24, through perforation 26*a* of barrel insert 26, and through barrel 22 into the position shown in FIGS. 15 and 16 (top view). As previously mentioned, dimension y of spring clasp 20 is smaller than dimension x of the barrel insert perforation 26*a* thus allowing the passage of spring clasp 20 through female assembly 30 of barrel lock 10. Upon complete insertion of spring clasp 20 into female assembly 30, notches 20*e* of spring clasp 20 engage disk 24 at the narrower opening (due to the spring tension of spring clasp 20) thus fully locking spring clasp 20 and female assembly 30 together.

In a preferred embodiment of the invention, disk opening 24*a* is plus-shaped which enables spring clasp 20 to be inserted through disk 24 in one of two rotational positions (i.e., the plane of barrel insert 26 of female assembly 30 can be at either 0° or 180° from the plane of arm 20*a* on spring clasp 20). Opening 24*a* may also have different shapes. In general, it is desirable for disk opening 24*a* to have a relatively wide center passage to enable the entry of arms 20*a* and 20*b* of spring clasp 20 and an area of reduced width to engage notches 20*e*.

To release spring clasp 20 from female assembly 30, head 20*d* and eye 20*f* of spring clasp 20 are squeezed together thus disengaging notches 20*e* from disk 24. While squeezing, spring clasp 20 is extracted from female assembly 30 until end 26*c* of barrel insert 26 prevents further extraction thereof. FIGS. 13 and 14 illustrate this partially opened (or partially closed) position. Spring clasp 20 is then brought into the position shown in FIG. 11 and arm 20*b* of spring clasp 20 is brought down, passing through, and out of engagement with barrel insert 26.

From the foregoing description, it can be appreciated that the barrel lock of the present invention provides functional, structural and construction (fabrication) advantages over existing fastening devices. Firstly, only four elements are utilized to fabricate the barrel lock, one element (i.e., spring clasp 20) for the male component, and three elements (i.e., barrel 22, disk 24 and barrel insert 26) for female assembly 30. Further, the assembly of the components of female assembly 30 is relatively simple, straight-forward and inexpensive in that barrel 22, disk 24 and barrel insert 26 can be affixed in a single tray soldering operation.

Secondly, the barrel lock of the present invention is functionally reliable in that two locking mechanisms are provided. The primary locking device being the engagement of notches 20*e* to disk 24 when spring clasp 20 and female component 30 are in the fully locked position. A second, backup, locking mechanism to prevent spring clasp 20 from being fully released from female assembly 30 is provided by the looping of spring clasp 20 around end 26*c*. The second locking mechanism is generally engaged should the first locking mechanism fail or be inadvertently released.

Finally, barrel lock 10 is structurally advantageous over certain existing devices in that the particular design of the components ensures that spring clasp 20 and female assembly 30 will not disengage from one another in the event of particular mechanical failures of barrel lock 10 including, but limited to, detachment of barrel 22 and disk 24, detachment of barrel 22 and barrel insert 26, and detachment of disk 24 and barrel insert 26. Because one end of a chain is attached to barrel insert 26, and barrel insert 26 engages disk 24, and disk 24 engages spring clasp 20 to which the other end of the chain is attached, the barrel lock of the present invention can perform its intended function even if none of the elements of female assembly 30 are permanently coupled (e.g., soldered).

While the present invention has been particularly shown and described in conjunction with a preferred embodiment thereof, it will be readily appreciated by those of ordinary skill in the art that various changes may be made without departing from the spirit and scope of the invention. For example, and as previously mentioned, the particular shapes of the various elements need not be exactly as described.

As another example, although the present discussion is directed to a barrel lock for use with a bracelet or necklace, the present invention is not limited solely to these types of jewelry and may be widely used with other forms of jewelry or non-jewelry in which two parts thereof need to be removably coupled together.

Still further, although female assembly 30 of the barrel lock has been described as being comprised of three elements, less than three, or even more than three, elements may be used to fabricate the female component having the functions and advantages disclosed herein.

Therefore, it is intended that the appended claims be interpreted as including the embodiments described herein, the alternatives mentioned above, and all equivalents thereto.

What is claimed is:

1. A barrel lock for jewelry, comprising:

a tubular member having first and second tube ends, a hollow interior and a circumscribing interior wall;

a disk affixed to the first tube end, said disk having an outer face and an aperture extending from said outer face to the hollow interior of said tubular member;

a substantially flat annular member having a first end, a central section and a second end, the central section of said annular member bearing against opposed faces of the interior wall of said tubular member, said first and second ends of said annular member extending, respectively, beyond the first and second tube ends, said first end of said annular member projecting through the aperture in the disk, and said first and second ends of said annular member defining, respectively, first and second loops extending from said tubular member; and a spring clasp adapted to pass through said first loop and also through the aperture of the disk and to lie within the tubular member after passing through said disk aperture, said spring clasp having lock means to engage and lock with the edges of the disk aperture when the spring clasp is fully inserted into the annular member.

2. The barrel lock of claim 1 wherein the annular member bears against said opposed faces of the interior wall of the tubular member at the largest cross-section of the annular member.

3. The barrel lock of claim 2 wherein the width of the central section of the annular member is substantially the same as the width of the tubular member at its largest internal cross-section.

4. The barrel lock of claim 3, wherein the means provided on said spring clasp to engage and lock with the disk aperture is a pair of notches on said spring clasp, and said disk aperture is comprised of a relatively wider portion communicating with a relatively narrower portion wherein the relatively wider portion of said aperture is adapted to permit the passage of said spring clasp therethrough and said relatively narrower portion of said spring clasp is adapted to permit the passage therethrough of the notches on said spring clasp but not the spring clasp.

5. The barrel lock of claim 3, wherein the spring clasp includes an eye for attachment of one end of a jewelry chain, and wherein the second loop extending from the annular member is for attachment of an opposite end of the jewelry chain.

6. The barrel lock of claim 3 wherein the first end of the annular member engages and holds the disk in a position abutting the first tube end.

7. A barrel lock, comprising:

a hollow cylindrical barrel having first and second barrel ends;

a disk coupled to the first end of the barrel and having an opening;

a barrel insert inserted within and coupled to the barrel, said insert having first and second insert ends, said first and second insert ends extending, respectively, beyond the first and second barrel ends, the insert having a perforation extending into the first and second insert ends, the first end of the insert engaging the disk to prevent the first end of the insert from passing through the barrel; and a spring clasp adapted to pass through the perforation of the first insert end and also being adapted to pass through the opening of the disk and lie within the barrel after passing through the insert perforation, said spring clasp being provided with locking means to engage and lock with the disk when the spring clasp is fully inserted.

8. The barrel lock of claim 7, wherein the spring clasp includes an eye enabling attachment of one end of a jewelry chain, and wherein the second end of the barrel insert is attached to a second end of said jewelry chain.

9. The barrel lock of claim 8, wherein the opening of the disk is plus-shaped and the locking means on the spring clasp is a pair of notches abutting against edges of the plus-shaped opening of the disk.

10. The barrel lock of claim 7, wherein the first insert end engages the spring clasp when the spring clasp is released from the locked position.

11. A barrel lock for connecting together opposite ends of a string of jewelry, comprising:

a spring clasp consisting of a strip of metal bent over on itself to define opposing first and second arms connected by a U-shaped end, said first arm including an eye at an open end for securement of a first end of said string of jewelry, and said second arm having a head at an open end with notches on said second arm in juxtaposition to said head;

a hollow barrel having first and second open ends;

a disk attached to a first end of said barrel, and said disk having an opening of a shape in which a relatively wider opening communicates with a narrower opening, and said notches on said spring clasp engaging said disk at said narrower opening upon insertion of said spring clasp into said barrel; and a barrel insert consisting of a strip of metal and having a first end of U-shape and a second end of rectangular shape, a second end of said string of jewelry being connected to said first end of said insert, said insert being positioned within said barrel with said first end of said insert extending from said second end of said barrel and said second end of said insert extending from said first end of said barrel, said second end of said insert being wider than the widest portion of any opening in said disk, and said insert having a central perforation for receiving said spring clasp.

12. A barrel lock for connecting together the opposite ends of a string of jewelry, comprising:

a spring clasp consisting of a strip of metal bent over on itself to define adjacent first and second arms connected by a U-shaped end, said first arm including an eye at an open end for securement of a first end of said string of said jewelry, and said second arm having a head at its open end with two notches on said second arm in juxtaposition to said head;

a hollow barrel having first and second open ends;

a disk attached to a first end of said barrel, and said disk having an opening of a shape in which a relatively wider opening communicates with a narrower opening, and said notches on said spring clasp engaging said disk at said narrower opening upon insertion of said spring clasp into said barrel; and a barrel insert consisting of a strip of metal and having a first end of U-shape and a second end of rectangular shape, a second end of said string of jewelry being connected to said first end of said insert, said insert being positioned within said barrel with said first end of said insert extending from said second end of said barrel and said second end of said insert extending from said first end of said barrel, said second end of said insert being wider than the widest portion of any opening in said disk, and said insert having a central perforation for receiving said spring clasp;

wherein said spring clasp is inserted into an assembly of said barrel, disk and barrel insert to lock the two ends of said string of jewelry together by positioning said spring clasp into a perpendicular position with respect to an axis of said barrel, said first arm of said spring clasp being passed through said second end of said insert, said spring clasp being moved into parallel alignment with said axis of said barrel and said spring clasp being inserted through said disk and into said central perforation of said insert until said spring clasp is fully positioned in a locked position with said notches of said spring clasp engaging said disk at its narrower opening.

* * * * *